US008956313B2

(12) United States Patent
Bryant

(10) Patent No.: US 8,956,313 B2
(45) Date of Patent: Feb. 17, 2015

(54) POWERED ROCKING CHAIR

(76) Inventor: Amy Bryant, Atlanta, GA (US)

( * ) Notice: Subject to any disclaimer, the term of this patent is extended or adjusted under 35 U.S.C. 154(b) by 809 days.

(21) Appl. No.: 13/053,116

(22) Filed: Mar. 21, 2011

(65) Prior Publication Data

US 2012/0022412 A1 Jan. 26, 2012

Related U.S. Application Data

(60) Provisional application No. 61/315,878, filed on Mar. 19, 2010.

(51) Int. Cl.
*A61H 1/00* (2006.01)
*A47C 3/02* (2006.01)

(52) U.S. Cl.
USPC ..... 601/24; 601/31; 297/260.2; 297/271.4

(58) Field of Classification Search
CPC ..... A61H 1/00; A61H 1/02; A61H 1/0266; A47C 3/029; A47D 13/10; A63B 23/08; A63B 23/085; A63B 22/16
USPC ..... 601/24, 31, 89; 297/260.1, 260.2, 297/260.3, 261.2, 271.1, 271.3, 271.4; 482/79, 80, 146
See application file for complete search history.

(56) References Cited

U.S. PATENT DOCUMENTS

| | | | | | |
|---|---|---|---|---|---|
| 264,917 | A | * | 9/1882 | Andrews | 297/133 |
| 576,077 | A | * | 1/1897 | Hedberg | 297/118 |
| 918,737 | A | * | 4/1909 | Curtiss | 297/260.3 |
| 1,241,277 | A | * | 9/1917 | Postredny | 297/260.3 |
| 1,509,793 | A | * | 9/1924 | Thompson | 482/79 |
| 3,361,427 | A | * | 1/1968 | Paves | 482/146 |
| 3,525,522 | A | * | 8/1970 | Piller | 482/80 |
| 3,774,961 | A | * | 11/1973 | Lecarpentier | 297/260.3 |
| 3,789,836 | A | * | 2/1974 | Girten | 601/31 |
| 3,886,608 | A | * | 6/1975 | Casella | 5/108 |
| 4,003,374 | A | * | 1/1977 | Mizrachy | 601/89 |
| 4,199,137 | A | * | 4/1980 | Giguere | 482/79 |
| 4,270,749 | A | * | 6/1981 | Hebern | 482/80 |
| 4,775,184 | A | * | 10/1988 | Larkin | 297/260.2 |
| 4,862,875 | A | * | 9/1989 | Heaton | 601/26 |
| 5,267,924 | A | * | 12/1993 | Miller et al. | 482/79 |
| 5,368,361 | A | * | 11/1994 | Wen-Ming | 297/260.2 |
| 5,433,684 | A | * | 7/1995 | Carrillo | 482/80 |
| 5,468,217 | A | * | 11/1995 | Garcia et al. | 601/32 |
| 5,574,339 | A | * | 11/1996 | Kattwinkel et al. | 318/10 |
| 5,851,166 | A | * | 12/1998 | Bernardson | 482/79 |

(Continued)

OTHER PUBLICATIONS

Henderson, Rocking Chair Therapy for: Cancer, Gastric, Colon, Small Bowel, Pancreatic and Liver surgeries, Dec. 21, 2009. Life Zone. <http://www.lifezone.com/2009/12/rocking-chair-therapy-for-cancer-gastric-colon-small-bowel-pancreatic-and-liver-surgeries>.*

*Primary Examiner* — Justine Yu
*Assistant Examiner* — Christopher Miller

(57) ABSTRACT

This application is related to an apparatus and method for improving venous blood flow in mobility-impaired patients. In one aspect, the apparatus is a motorized or powered rocking chair with a footplate. The rocking chair and footplate rotate through physiologically relevant ranges of motion either at the same frequency or at different frequencies in order to mechanically induce a calf muscle pump action in the dependent legs of a mobility-impaired patient. Artificially inducing the calf muscle pump action in such patients acts to boost the action of the heart and lessen blood pooling in the lower extremities of the legs.

11 Claims, 5 Drawing Sheets

(56) References Cited

U.S. PATENT DOCUMENTS 6,152,529 A * 11/2000 Beason ..... 297/260.2
6,217,488 B1 * 4/2001 Bernardson ..... 482/79
6,328,378 B1 * 12/2001 Erickson ..... 297/133
2002/0165069 A1 * 11/2002 Ravikumar et al. ..... 482/80
2007/0063558 A1 * 3/2007 Stewart ..... 297/260.2
2008/0073958 A1 * 3/2008 Bellin ..... 297/261.2
2009/0240174 A1 * 9/2009 Keimowitz ..... 601/31

* cited by examiner

POWERED ROCKING CHAIR

CROSS-REFERENCE TO RELATED APPLICATION

The present invention claims the benefit of a provisional U.S. patent application filed by Bryant et al. on Mar. 19, 2010 and of provisional U.S. Patent Application Ser. No. 61/315,878.

BACKGROUND OF THE INVENTION

1. Field of the Invention

The present invention pertains generally to methods and apparatus for improving venous blood flow in mobility-impaired patient populations, and more particularly to motorized rocking chairs and rocking methods that would increase venous blood flow in the lower extremities of patients.

2. Background

People with decreased voluntary movement in their lower limbs are at high risk of Deep Vein Thrombosis (DVT), which may lead to pulmonary embolism and cardiac arrest. DVT is a life-threatening condition occurring during inpatient medical treatment, outpatient rehabilitation, and many mainstream activities such as long-haul airplane flights. One of the risk factors for DVT is prolonged immobility. People with mobility impairments, particularly those who rely on wheelchairs for mobility, are especially vulnerable to DVT. Current DVT prophylaxis options consist of pharmacologic anticoagulants, vena cava filters, and mechanical devices. Vena cava filters do not prevent DVT; they only act to prevent blood clots by trapping them so they clots do not embolize. Mechanical devices include graduated compression stockings, intermittent sequential compression devices, rotating tables and apparatus for electrical stimulation of the calf muscles. Mechanical devices have the advantages of ease-of-use and minimal side effects over other DVT prophylaxis options. Presently, many of these mechanical devices have a large footprint, are expensive, don't allow for customization and are ineffective to ameliorate blood pooling in the lower extremities of patients at an acceptable clinical level independent of other prophylactic modalities. There is a need for less costly and more versatile device-based solutions to improve venous blood flow of the lower extremities and reduce the risk of DVT in the mobility-impaired patient population.

SUMMARY

This application relates to apparatus and methods, along with systems associated therewith, for improving venous blood flow in mobility-impaired patients, and more particularly to powered or motorized rocking chairs and associated methods that increase venous blood flow in the lower extremities of patients. The motorized rocking chair or, optionally, power rocking wheel chair, is configured to move along a path determined by an arc length and radius, and at a set frequency, with the net effect of inducing the calf muscle pump to operate and prevent venous stasis in the patient's lower extremities. In order to create this calf muscle-induced blood movement, the patient is placed in a rocking chair with his feet secured to at least one footplate. The rocking chair causes the patient to rock forward, putting pressure on the patient's feet and causing plantarflexion. Then, the rocking chair rocks backward, causing the patient's foot to undergo passive dorsiflexion. This cyclic plantarflexion and dorsiflexion alleviates venous stasis in the lower extremities of the patient by promoting the corresponding filling and emptying of veins as the calf muscles contract and relax, squeezing the veins located therein.

DETAILED DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
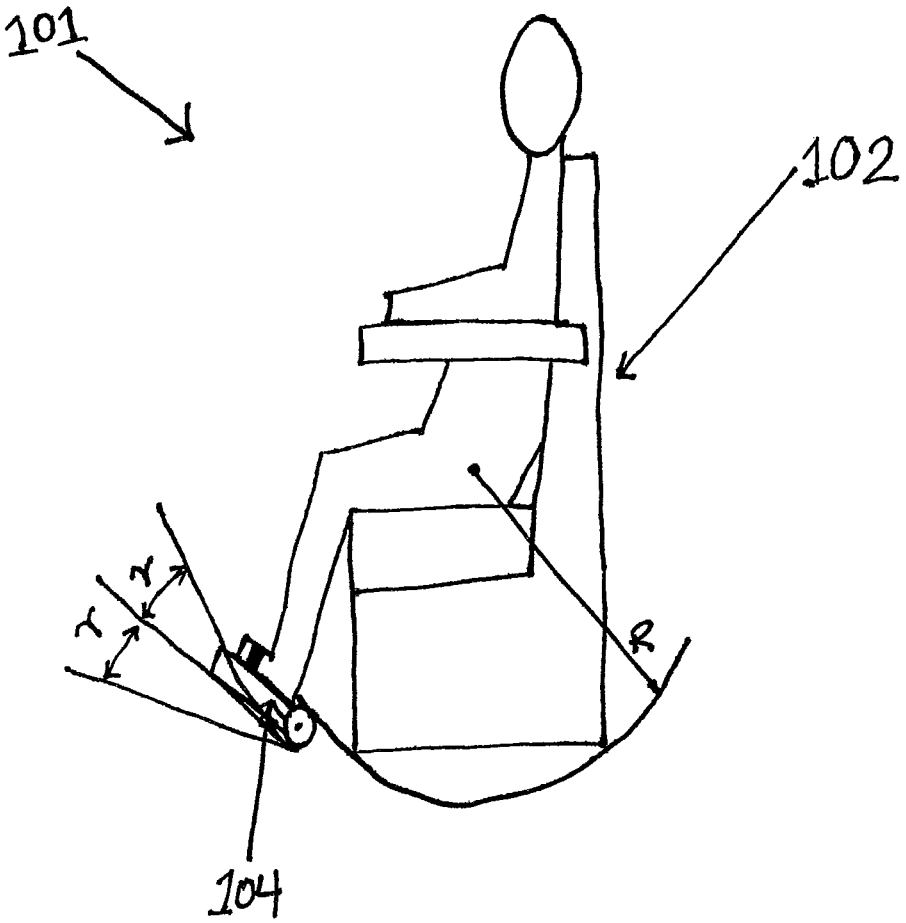
FIG. 1 is a schematic showing side view illustration of the basic features exemplary motorized rocking chair system.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "an assembly" can include two or more such assemblies unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "rocking chair" used absent any clear explanation of whether it refers to a "power rocking chair" or "rocking power wheel chair" specifically will refer to both power rocking chairs and power rocking wheel chairs.

The present invention hereby incorporates by reference U.S. Patent Application Ser. No. 61/315,878 filed by Bryant et al. on Mar. 19, 2010.

One aspect of this invention is a method to alleviate blood pooling in the lower extremities of mobility-impaired patients who, consequently, chronically sit or lie with their legs in a dependent position. The calf muscle pump is an action of the calf (soleus) muscles in which the muscles contract and squeeze the popliteal and tibial veins, forcing the blood in those veins to move upward toward the heart. A healthy calf muscle pump works automatically to boost the blood against gravity and ease it back up to the heart from the extremities. The calf pump of a healthy individual is active when that individual is standing with some degree of motion, e.g., walking, running or standing while shifting weight. Conversely, the calf muscle pump is inactive in individuals whose legs are in a dependent position such as sitting or lying down, or are standing still; this causes blood to pool in the lower extremities. In use of a conventional rocking chair, the foot of a non-impaired, mobile person presses the floor with an effective calf muscle pump causing the body to rock forward onto the foot. The foot meets resistance on the floor and the patient plantarflexes his foot to rock backward again. As the person's body rocks backward and his foot leaves the floor, the foot undergoes dorsiflexion. During the cycle of rocking, the mobile individual's use of his calf muscle pump (resulting from the cyclic plantar and dorsiflexion that occurs during the rocking cycle) increases venous blood flow in his legs, acting as a booster for the heart. More particularly, as the individual's body rocks backward, his feet at least partially leave floor and undergo dorsiflexion. This aids in refilling the veins both in and communicating with those located in the legs. When the individual rocks forward, his feet undergo plantarflexion. Plantarflexion aids in propelling the blood back to the heart along the veins both in and communicating with those located in the legs. During the plantarflexion/dorsiflexion cycle, the heart continues to pump blood and the calf muscle pump acts as a booster for the heart.

In order to create this calf pump-induced blood movement via mechanical intervention in mobility-impaired patients, the following method is employed either in a power rocking chair or a power rocking wheel chair: First, the rocking chair causes the patient's body to rock forward. The patient's feet press against the footplate of the chair, thus creating pressure on the bottom of the patient's feet. The forward rocking movement causes the muscles of the anterior lower leg to shorten passively, contracting the muscles of the anterior calf and elongating the muscles of the back of the lower leg. This action squeezes the deep veins, acting as a booster to the heart, and, thus, reduces venous stasis. Second, the backward rocking movement causing a release of pressure on the foot resulting from the footrest. This action relaxes and elongates the anterior muscles, shortens the posterior muscles and promotes refilling of the vein with blood. This rocking method induces the calf muscle pump of a mobility-impaired patient to operate, thereby alleviating venous stasis in the lower extremities of the patient by promoting filling of the veins when the foot plantarflexes and emptying the veins when the foot dorsiflexes. The rocking motion is configured to cause a range of movement from plantarflexion through passive dorsiflexion of the patient's foot in an arc that is limited to approximately the normal range of motion of the ankle joint. This mechanically induced rocking motion is analogous to a backyard water pump—the up motion primes the column and the down motion empties the column.

In one aspect of this invention shown in FIG. 1, the main parts of a power rocking chair 101 include a rocking chair 102, an in hub motor (not shown) and a footrest 104. The in hub motor is placed underneath the rocking chair and in a position that allows it to rock the chair back and forth at a steady pace. The hub motor is used can be merely a plain servomotor, i.e., a motor plus transmission, in one embodiment. The use of a hub motor is advantageous in this modality because it is low cost, has a small volume, produces low noise, is easy to install, requires relatively little maintenance and outputs a low speed but a high torque. However, other motors could be employed as is obvious to one skilled in the art. The footrest is movably attached to the wheelchair and configured so that it cycles with each rocking motion of the rocking chair, causing the patient's foot to undergo cyclic plantarflexion and dorsiflexion. The footrest is designed to cause plantar flexion to about 50° and dorsiflexion to about 20°. More particularly, the footrest is designed to cause plantar flexion to about 25° and dorsiflexion up to about 10°. Even more particularly, the footrest is designed to cause plantarflexion to about 20° and dorsiflexion up to about 7°. All measurements for plantarflexion and dorsiflexion are relative to a reference position of 0° where the anterior surface of the foot is substantially perpendicular to the anterior leg. Another alternative is for the footrest to utilize a pressure gage (e.g., a spring mechanism) that is configured to be gentle enough to take the foot through the range of motion without overextending it. This pressure gage or, more particularly, spring mechanism would ensure that motion stopped as the limit of the range of motion for the patient's feet were achieved in either plantarflexion or dorsiflexion via it's own spring constant or additional mechanical stops in order to guard against any injury to the patient. The footrest has an optional means to hold the patient's foot in place in order to ensure that passive dorsiflexion occurs. An electric control module is provided to regulate speed and amplitude of the rocking motion as well as allow for time-regulated use of the rocking chair. An optional off switch (e.g., a sip and puff switch) easily accessed by the patient is also contemplated. The rocking chair is configured to rock back and forth once with a full cycle of the hub motor. Since the hub motor is underneath the rocker, it saves room and this chair would not be larger or taller than the typical rocking or wheel chair, thereby saving material cost and room.

Figure 2:
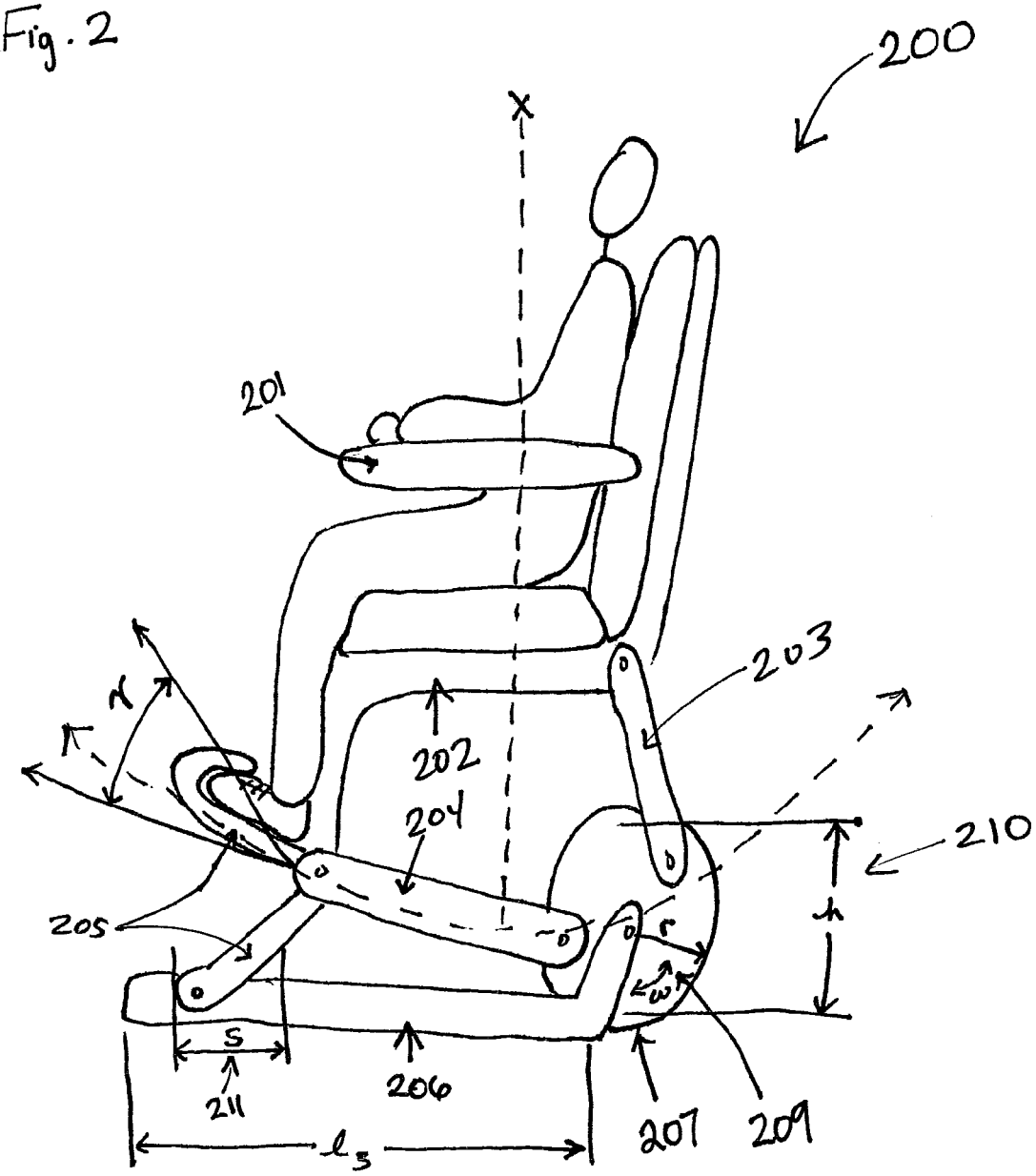
FIG. 2 is a schematic showing an expanded side view illustration of one exemplary design of a motorized rocking chair of the present invention.
Figure 3:
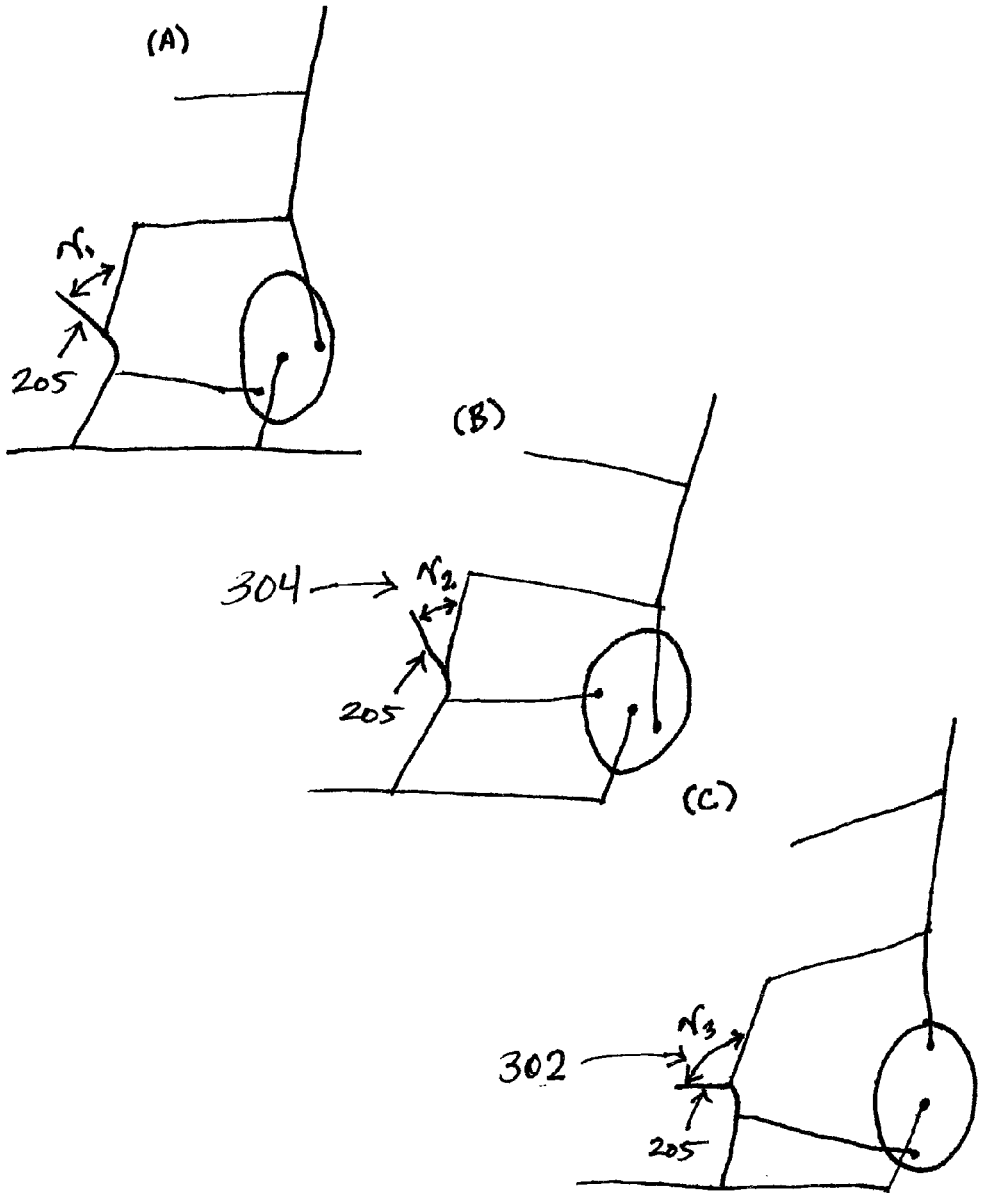
FIG. 3 is a schematic illustrating one cycle of the method of increasing venous flow in the lower extremities of a patient of the present invention.

One aspect of the present invention is illustrated in FIG. 2. The rocking chair 200 comprises a hub motor 207 configured to turn both clockwise and counter clockwise along a predetermined arc length (w) 209. The frequency of the rocking chair motion along the arc of rocking can be from about 0.01 Hz to about 1.3 Hz and, more particularly, from about 0.1 Hz to about 1 Hz. The radius (r) of the disk of the motor 207 will determine the amplitude 210 of rocking of the chair (h). The amplitude 210 of the rocking chair 200 can optionally be configured to be adjustable. The amplitude 210 of the rocking chair 200 can range from about 0.0 m to about 0.4 m and, more particularly, from about 0.1 m to about 0.3 m. A first linkage 203 connects the motor 207 to the supporting frame 202 of the rocking chair 200 thereby causing the supporting frame 202 to rock along the rocking arc proscribed using a central point 209. The radius of the rocking arc (R) is from about 0.8 to about 1.6 meters and, more particularly, from about 1.0 to about 1.3 meters. A second linkage 204 connects the motor 207 to the footrest frame 205 thereby causing the footrest frame 205 to oscillate at a frequency from about 0.01 Hz to about 1.3 Hz and, more particularly, from about 0.1 Hz to about 1 Hz. FIG. 300 shows the motion of the rocking the chair at three points in one complete rocking cycle. The footplate 205 is hinged along the at least a portion of the length of its lower end and configured to change relative position with the chair frame throughout the rocking cycle and has a sliding range 211 to facilitate the foot flexion motion. This footplate is configured to move in either a 1:1 cycle with the hub motor to a prescribed angle of dorsiflexion 302 and plantarflexion 304 or can be configured to be controlled independently of the hub motor powering the rocking of the chair 200. The hub motor 207 and the footrest 205 are attached to the base 206 of the rocking chair 200.

If an independent foot rest is desired, a kinetic or continuous passive motion ankle machine is one example of a mechanism that can be added to the footrest to impart independent movement of the foot rest to the chair rocking mechanism. Thus, the footrest could be used alone or at a different frequency than the rocking motion. This allows for the device ascending to the present invention to provide more treatment options.

Figure 4:
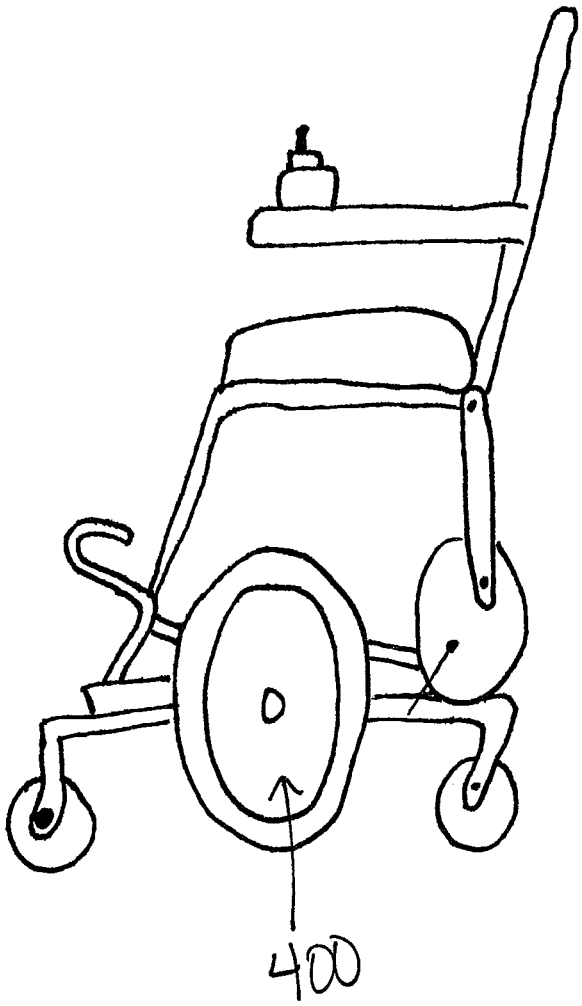
FIG. 4 is a schematic illustrating yet another modality of a powered rocking wheel chair system having a middle wheel driver motor.

FIG. 4 depicts one more aspect of the invention that is a powered rocking wheel chair. The rocking chair mechanism described in FIGS. 1 and 2 along with the corresponding text can be married with a power wheel chair to impart additional rocking and foot flexing functionality. In this case, a power wheel chair having a middle wheel chair driver motor 400 is used along with the same servomotor and linkages described for the power rocking chair of FIGS. 1 and 2. Thus, patients do not have to be moved from one chair to another to take advantage of the methods comprising this invention.

In one aspect of the invention, the electric control module comprises a conventional wheelchair controller and will be utilized to control the rocking of the chair. The chair can be equipped with standard controls that offer pre-selected levels of frequency of rocking or the chair can have a control that allows for adjustment from slow to fast. Both types of controls are standard and obvious to one skilled in the art.

The supporting frame 202, the arm rest 201, the first linkage 203, the second linkage 204, the footrest frame 205 and the base of the rocking chair 206 can all be manufactured by using deformable tubing and or cast resin parts along with joints that provide the proscribed range and degrees of motion.

Figure 5:
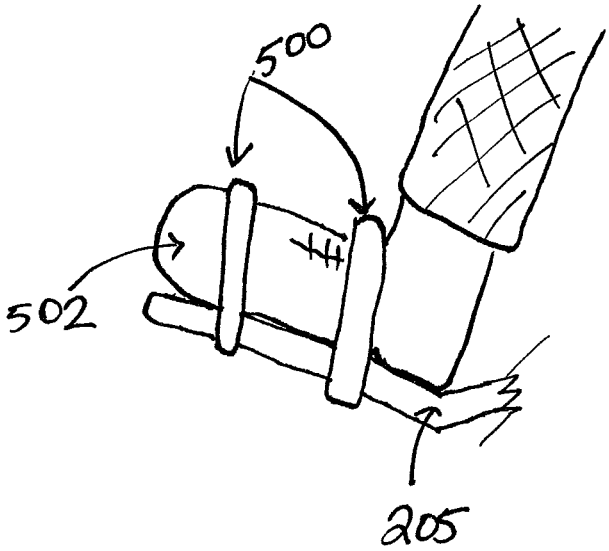
FIG. 5 is a schematic illustrating a side view of an inflatable bladder modality to secure a foot to a footrest.
Figure 6:
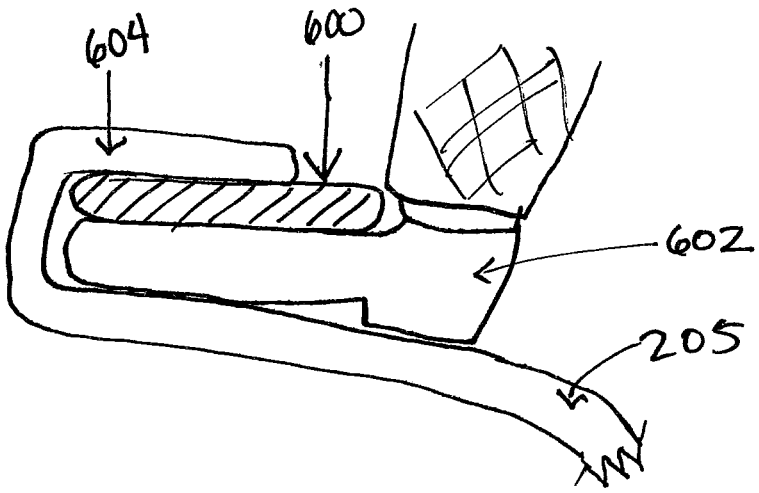
FIG. 6 is a side view of an adjustable elastic band modality used to secure a foot to a footrest.

Another optional aspect of the invention is that the patient's feet can be individually secured to the footrest frame 205 in order to ensure dorsiflexion. This can be accomplished by a variety of means. In one aspect, as shown in FIG. 5, adjustable elastic belts 500 can be used to secure the feet 502 to the footplate 205. Alternatively, and as illustrated in FIG. 6, an inflatable bladder 600 can be used to secure the foot 602 to the footplate 205. In this case, the footplate 205 has a lip 604 under which the patient places his feet.

Yet another aspect of the invention is the use of a power system comprising a hub motor and batteries. The hub motor should have a rated power from about 150 to about 300 watts; a rated voltage from about 24 to about 36 volts; a rated current from about 2 to about 6.5 amperes; a range of speed from about 1200 to about 2200 revolutions per minute; an optional efficiency of about 80%, an optional noise level of les and a torque from about 10 to about 16 Newton-meters. A sufficient power supply for such a motor can comprise two 12V wheelchair batteries.

Another aspect of this invention is a method to reduce the occurrence of DVT by rocking a patient in a motorized chair while also causing both plantar flexion and dorsiflexion of the foot at a rocking amplitude from about 0.0 m to about 0.4 m and a rocking and foot flexing frequency of about 0.1 Hz to about 1.0 Hz, with an arc of rocking of about 1.0 m to about 1.3 m.

In another aspect of this invention, three current neuroscience-based sensors, namely EEG, EMG and GSR can be used for used for patient monitoring in conjunction with an accelerometer. That means they will systematically record physiological signals that reflects evolved changes in a patient's nervous system and its relationship with acceleration of the rocking chair. The three sensors' functions are described as follows:

Electroencephalography (EEG):

Comprises a Brain Computer Interface (BCI) that exploits neurophysiological signals from the brain to control external devices. The most useful nervous system monitoring is EEG due to the feasibility in acquiring the signals and low equipment costs. EEG has been used to investigate brain functions, neurological disorders, and in other various therapeutic studies.

Surface Electromyography (SEMG):

EMG is a technique that evaluates the electrophysiological activity of muscles by measuring the action potential generated when a muscle is contracted. To obtain these measurements, a needle electrode is inserted into the muscle and the electrical activity is displayed on an oscilloscope or heard through a speaker. A noninvasive version of EMG is SEMG, where electrodes are placed on the skin overlying the muscle. The amplitude, frequency, and shape of the waveform obtained from the sensors applied to the skin overlying the muscle of interest provides information about the ability of the muscle to respond when the nerves are stimulated from the acceleration from the rocking chair.

Galvanic Skin Response (GSR):

GSR is the measure of fluctuations in skin conductance that reflects changes in skin sympathetic nerve activity. Skin conductance is measured by recording the electrical conductance when weak current (i.e., at a level that cannot be perceived) is delivered between two electrodes that are attached to different sites on the skin surface. Skin conductance between the two electrodes will increase due to increased activity of sweat glands in response to increased skin sympathetic nerve activity. Sweat glands receive signals from sympathetic cholinergic fibers that use acetylcholine as neurotransmitter.

At least one of the three types of sensors and the data recording equipment (i.e., with the capability to record and download acceleration data) are connected with a laptop through a multichannel A/D and USB port will aid in diagnosing the proper rocking and footrest movement parameters.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A method for reducing the occurrence of deep vein thrombosis, comprising:

positioning a mobility-impaired patient in a rocking chair, wherein the rocking chair comprises:

a rocking chair frame operably connected to a first linkage;

a footrest frame operably connected to a second linkage;

a motor having a disk, wherein each of the first linkage and the second linkage are each coupled to the disk and wherein the motor is operable to rotate the disk at a selected rocking frequency back and forth along a selected rocking arc length thereby causing the rocking chair to rock the patient and causing the footrest frame to rotate relative to the rocking chair frame;

rocking the patient in the rocking chair frame along the selected rocking arc length and at a selected rocking amplitude and the selected rocking frequency; and causing the patient's feet positioned in the footrest frame to undergo cyclic plantarflexion and dorsiflexion along a predetermined selected range of angles and at a selected flexion frequency.

2. The method of claim 1, wherein the selected rocking arc length is from about 1.0 meter to about 1.3 meters.

3. The method of claim 1, wherein the selected rocking amplitude is from about 0.0 meters to about 0.4 meters.

4. The method of claim 1, wherein the selected rocking frequency is from about 0.1 Hz to about 1.0 Hz.

5. The method of claim 1, wherein the flexion frequency is from about 0.1 Hz to about 1.0 Hz.

6. The method of claim 1, wherein the predetermined selected range of angles is from about 50° degrees of plantarflexion to about 20° of dorsiflexion.

7. The method of claim 6, wherein the predetermined selected range of angles is from about 25° degrees of plantarflexion to about 10° of dorsiflexion.

8. The method of claim 7, wherein the predetermined selected range of angles is from about 20° degrees of plantarflexion to about 7° of dorsiflexion.

9. The method of claim 1, where the selected rocking frequency and the selected flexion frequency occur in a substantially 1:1 ratio.

10. The method of claim 1, where the selected rocking frequency and the selected flexion frequency do not occur in a substantially 1:1 ratio.

11. A method to induce the calf muscle pump in mobility-impaired patients, comprising:

positioning a patient in a rocking chair, wherein the rocking chair comprises:

a rocking chair frame operably connected to a first linkage;

a footrest frame operably connected to a second linkage;

a motor having a disk, wherein each of the first linkage and the second linkage are each coupled to the disk and wherein the motor is operable to rotate the disk at a selected rocking frequency back and forth along a selected rocking arc length thereby causing the rocking chair to rock the patient and causing the footrest frame to rotate relative to the rocking chair frame;

rocking the patient in the rocking chair frame at an amplitude from about 0.0 meters to about 0.4 meters and, causing the patient's feet positioned in the footrest frame to undergo cyclic flexion at a frequency from about 0.1 Hz to about 1.0 Hz;

wherein the selected rocking frequency is from about 0.1 Hz to about 1.0 Hz and the selected rocking arc length is from about 1.0 meters to about 1.3 meters.

* * * * *